United States Patent [19]

D'Urso

[11] Patent Number: 4,934,966

[45] Date of Patent: Jun. 19, 1990

[54] ELECTRICAL TAB-RECEPTACLE

[75] Inventor: Gianfranco D'Urso, Turin, Italy

[73] Assignee: AMP Incorporated, Harrisburg, Pa.

[21] Appl. No.: 370,553

[22] Filed: Jun. 23, 1989

[51] Int. Cl.[5] ..... H01R 11/22

[52] U.S. Cl. ..... 439/849; 439/850

[58] Field of Search ..... 439/839, 842, 845, 846, 439/848, 849, 850, 352, 354, 357, 358, 266, 268, 270

[56] References Cited

U.S. PATENT DOCUMENTS

| | | | |
|---|---|---|---|
| 3,546,665 | 12/1970 | Zak | 439/848 |
| 3,573,709 | 4/1971 | Elliott | 439/848 |
| 4,478,470 | 10/1984 | Fruchard et al. | 439/268 |
| 4,713,026 | 12/1987 | Mobley et al. | 439/845 |

FOREIGN PATENT DOCUMENTS

| | | | |
|---|---|---|---|
| 0037995 | 10/1981 | European Pat. Off. | 439/849 |
| 0098650 | 1/1984 | European Pat. Off. | 439/849 |

*Primary Examiner*—David Pirlot

*Attorney, Agent, or Firm*—William B. Noll

[57] ABSTRACT

A tab-receptacle of known type comprises a pair of side walls upstanding from a base and having edge portions in-turned towards the base opposite rails pushed up from material at the junction of the base and the side walls so that a mating tab will be gripped between the opposed edge portions and the rails. A latching tongue has a lance for latching engagement in an aperture of a mating tab and a release projection. Catch members are provided on ends of strap-like extensions of the respective side walls at the front of the receptacle and include a clasp and stop lugs arranged for interengagement after a predetermined movement apart of the side walls (necessary for tab insertion) to prevent further deflection apart and strain of the side walls otherwise caused by a misaligned tab.

5 Claims, 2 Drawing Sheets

ELECTRICAL TAB-RECEPTACLE

BACKGROUND OF THE INVENTION

The invention relates to electrical tab-receptacles, particularly to receptacles of the type providing releasable latching engagement with an apertured tab.

Receptacles of this type are disclosed in British Patent No. 1463751 and have become very widely adopted over the past ten years, particularly in the automotive industry. They provide both reliable mechanical latching to the mating tab and reliable electrical connection to the tab.

In one version, the receptacle is stamped and formed from sheet metal and comprises a generally channel-shaped receptacle portion having a base and upstanding side walls with free edge portions of the side walls turned in over the base for receiving a complementary tab between the turned-in edge portions of the side walls and a latching tongue which extends from the base, usually at the forward, tab-entry end of the receptacle portion and usually rearwardly within the receptacle portion, the free end of the tongue projecting out of the receptacle portion, usually at the rear, away from the base to form a release member, the portion of the tongue within the receptacle portion being formed with a lance for latching engagement in the recess or aperture in the mating tab, the tongue being resiliently flexible away from the tab by operation of the release member, to disengage the lance and release the tab.

In order to separate the mechanical and electrical characteristics, a pair of rails are formed to upstand from the base, usually by pushing up edges of longitudinally extending slots struck at the junction of the base and side walls, to present edges opposed to respective turned-in edges of the side walls, the tab being gripped between the opposed edges.

While this construction generally provides very reliable mechanical and electrical connection, the provision of the rails increases the overall height of the channel while the provision of the slots also weakens somewhat the side walls. In some applications, particularly where the receptacle and mating tab are freely suspended, a misalignment of the tab and receptacle, for example during mating in which the tab is twisted in its plane, will cause the opposite edges of the tabs at front and rear ends respectively to engage the respective side walls at corresponding locations above the rails, (remote from the base), imposing a substantial torque on the side walls, deforming them outwardly with consequent displacement of the in-turned contact edges upwardly, away from the rails, reducing the electrical connection to the tab.

In seeking a solution to this problem, it is important both not to substantially increase the insertion force necessary to effect mating with the tab and the cost and size of the receptacle.

SUMMARY OF THE INVENTION

According to the invention, at the forward end of the receptacle, inwardly directed extensions of the side walls remote from the base extend past each other and are linked together by catch members arranged to be brought into engagement with each other after movement apart of the side walls by a predetermined extent.

This permits the small degree of movement apart of the sidewalls necessary to admit the tab into the receptacle, thereby avoiding any undesirable increase in insertion force but limits such movement to prevent overstress and consequent loss of reliable electrical connection and possible reduction in mechanical retention which would otherwise arise.

More specifically, such inwardly directed portions of the side walls are mechanically isolated from the turned-in edge portions by slots extending transversely of the receptacle.

In a preferred construction, the catch members comprise transverse arms or lugs at the free ends of the inwardly directed extensions which are in overlapping relation, the arms on one extension embracing or clasping the other extension in alignment with and spaced from the other arms or lugs on the other extension.

This ensures that the catch members remain linked for engagement to provide strain relief in the adverse environments of handling and use.

An important aspect of this arrangement is that it enables the strain relief to be provided by simple modification of the die structure originally configured for stamping and forming two receptacles simultaneously, thereby saving very substantial costs of retooling equipment and minimising retooling delays.

DETAILED DESCRIPTION OF PREFERRED EMBODIMENT

Figure 1:
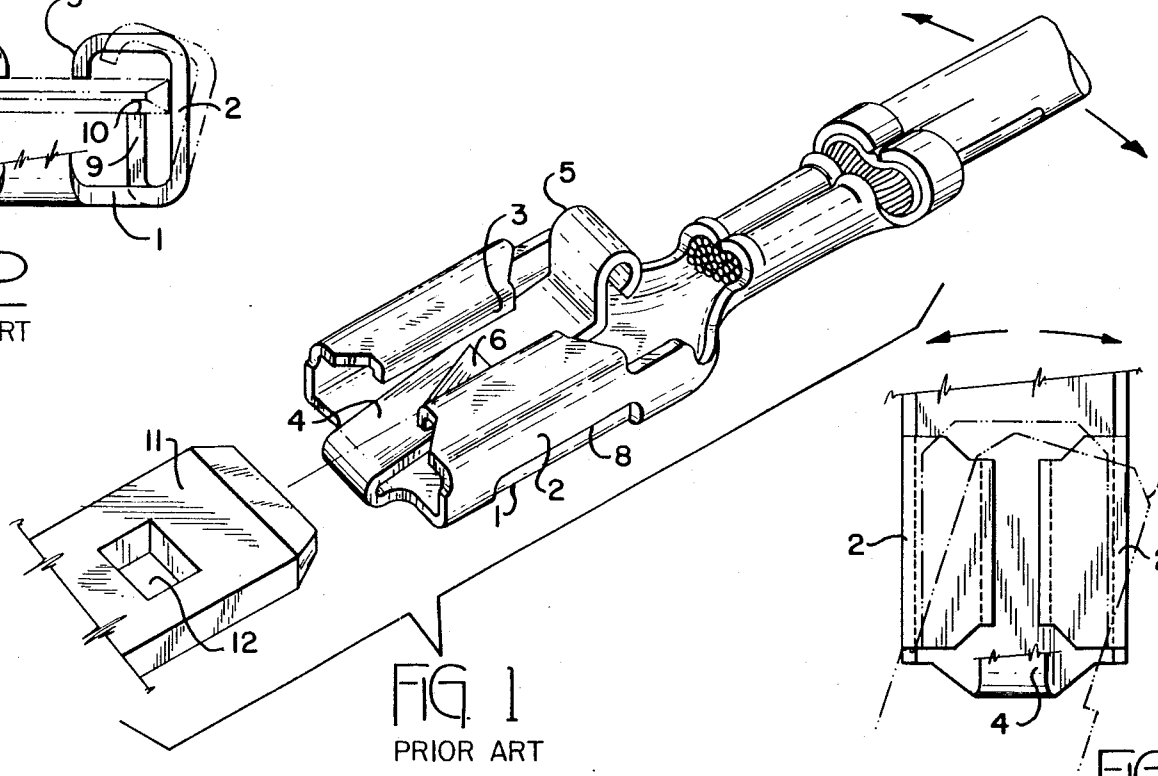
FIG. 1 PRIOR ART
FIG. 1 is a perspective view of a conventional electrical tab-receptacle and mating tab.
Figure 3:
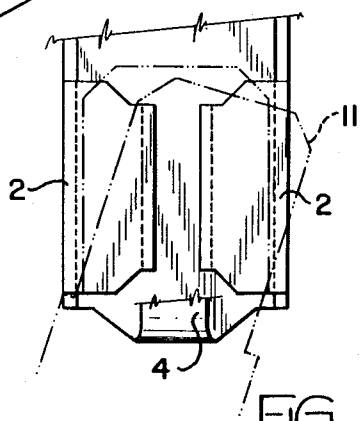
FIG. 3 PRIOR ART
FIG. 3 is a schematic fragmentary plan view of the conventional receptacle illustrating in broken lines the possible position of a misaligned tab.
Figure 2:
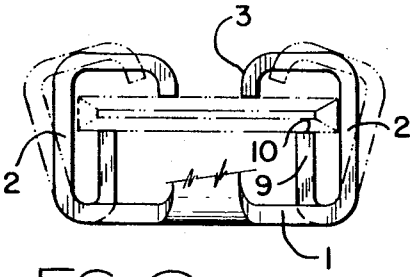
FIG. 2 PRIOR ART
FIG. 2 is a schematic cross-sectional view illustrating in broken lines the distortion of the conventional receptacle portion which may occur on mating with a misaligned tab.
Figure 4:
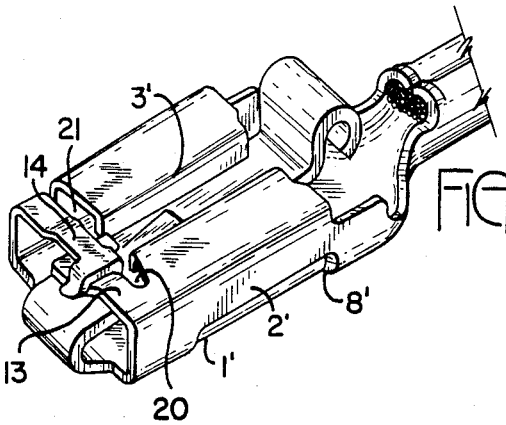
FIG. 4 is a perspective view of a tab-receptacle according to the invention.
Figure 5:
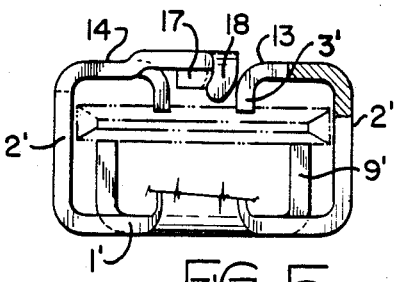
FIG. 5 is a schematic cross-sectional view of the receptacle portion.
Figure 6:
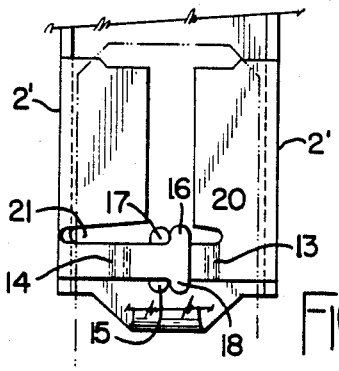
FIG. 6 is a schematic fragmentary plan view of the receptacle portion.
Figure 7:
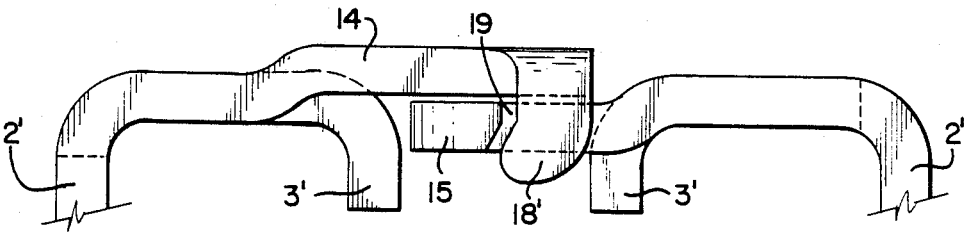
FIG. 7 is a schematic fragmentary front end view of the receptacle portion much enlarged.

As shown in FIGS. 1–3, the receptacle portion of the conventional receptacle is stamped and formed of sheet metal and is generally channel-shaped having a base 1 and upstanding side walls 2. Free edge portions 3 of the side walls 2 are turned in, over and towards the base 1.

A tongue 4, integral with the forward end of the base 1, is turned back between the side walls 2 to extend rearwardly in inclined manner towards the turned-in edge portions 3 of the side walls 2. The tongue 4 extends beyond the rearward ends of the tuned-in edge portions 3, and is then turned outwards generally perpendicular to the base 1 to project externally of the receptacle portion to form a release member 5. The tongue 4 is formed in a middle portion with a pushed-up lance 6 inclined rearwardly towards the turned-in edge portions 3 to present a latch for releasable engagement in an aperture 12 of a complementary tab 11.

Adjacent portions of the base 11 and sidewalls 2 have defined therein a pair of longitudinal slots 8, one on each side of the tongue 4, the metal from which slots is pushed up from the base 1 to present upstanding rails 9 with edges 10 opposed to the turned-in edge portions 3.

In use, as shown in FIG. 3, the mating tab 11 is clamped by resilient flexure of the turned-in edge portions 3 between the edge portions 3 and the edges 10. The latch lance 6 is received in the tab aperture 12 to resist mechanical withdrawal of the tab 11. Depression of the release member 5 towards the base 1 disengages the lance 6 from the aperture 12 to permit withdrawal of the tab 11 from the receptacle.

However, if the mating tab and receptacle are relatively misaligned or twisted as indicated by the arrows, opposite edges of the tab at the front and rear will abut the respective side walls at locations remote from the base, distorting the side walls outwardly as a result of the substantial turning moment produced, to the condition shown in FIG. 2 with consequent loss of elasticity and imperfect return. It will be observed that this will result in less contact force being imposed on the tab by the in-turned edge portions 3 as they will remain deformed away from the base rails, resulting in a significant loss of electrical reliability.

In the tab-receptacle according to the invention shown in FIGS. 4–7, in which similar parts are identified by prime reference numerals to facilitate understanding, inwardly directed strap-like extensions 13, 14 are provided on the respective side walls 2' remote from the base at the front end of the receptacle which extend past each other in overlapping relation and are linked together by respective catch members 15, 16 comprising transverse lugs 17 on the free end of one member 15 and transverse arms 18 of the free end of the other member 16, which arms are bent towards the base to extend in sliding engagement with respective opposite edges of the one member and at a predetermined spacing 19 from the lugs 17, in the unmated condition. The arms clasp and trap the one member 15 retaining the lugs and arms 17 and 18 respectively in alignment and the arms 18 may be hook-form more securely to trap the lugs 17. The extensions 13 and 14 are mechanically separated from the in-turned edge portions 3' by slots 20 and 21 respectively, slot 21 being of greater length to provide sufficient flexibility in extension 14 for the bent arms 18 to ride over and snap behind lugs 17 during the forming of the receptacle. The predetermined separation of the arms and lugs permits limited movement apart of the side walls 2' caused by flexure of the in-turned edge portions 3' by the tab away from the base during tab reception but, thereafter, the catch members engage to prevent further separation of the side walls 2'.

In this manner, strain of the receptacle which would otherwise be caused by relative mis-alignment with mating tabs is prevented without increasing the overall insertion force. In addition, by a small reduction in the conventional length of the in-turned edge portions 3', the receptacle can be produced by modifying a die formerly used to produce two conventional receptacles simultaneously.

I claim:

1. In an electrical tab-receptacle having a generally channel-shaped receptacle portion having a base and upstanding side walls with free edge portions of the side walls turned in over the base for receiving a complementary tab, having a lance receiving recess or aperture therein, between the turned-in edge portions of the side walls and a latching tongue which extends from the base, at the forward, tab-entry end of the receptacle portion and rearwardly within the receptacle portion, the free end of the tongue projecting out of the receptacle portion, at the rear, away from the base to form a release member, the portion of the tongue within the receptacle portion being formed with a lance for latching engagement in said recess or aperture in said complementary tab, the tongue being resiliently flexible away from the tab by operation of the release member to disengage the lance and release the tab, the improvement comprising at the forward end of the receptacle the provision of inwardly directed extensions are provided on the side walls remote from the base and extend past each other in an overlapping fashion, whereby they are linked together by catch members arranged to be brought into engagement with each other after movement apart of the side walls by a predetermined extent.

2. The electrical tab-receptacle according to claim 1, characterized further by said catch members comprising transverse arms or lugs at the free ends of the inwardly directed extensions which are in overlapping relation, whereby the arms on one extension embrace or clasp the other extension in alignment with and spaced from the other arms or lugs on the other extension.

3. The electrical tab-receptacle according to claim 1, characterized further by a pair of rails formed to upstand from the base to present edges opposed to respective turned-in edges of the side walls, with said tab being gripped between said opposed edges.

4. The electrical tab-receptacle according to claim 3, characterized further by said pair of rails formed to upstand from the base by pushing up edges of longitudinally extending slots struck at the junction of the base and side walls.

5. The electrical tab-receptacle according to claim 4, characterized further by said inwardly directed extensions of the side walls being mechanically isolated from the turned-in edge portions by slots extending transversely of the receptacle.

* * * * *